US006210244B1

(12) United States Patent
Nordby

(10) Patent No.: US 6,210,244 B1
(45) Date of Patent: Apr. 3, 2001

(54) SPLIT-BLADED PROPULSION APPARATUS

(76) Inventor: Willard E. Nordby, 5 Caramel Dr., Novato, CA (US) 94945

( * ) Notice: Subject to any disclaimer, the term of this patent is extended or adjusted under 35 U.S.C. 154(b) by 0 days.

(21) Appl. No.: 09/539,470

(22) Filed: Mar. 30, 2000

(51) Int. Cl.[7] ..... B63H 16/04
(52) U.S. Cl. ..... 440/101; 416/74
(58) Field of Search ..... 440/101; 416/70 R, 416/74; D12/215

(56) References Cited

U.S. PATENT DOCUMENTS 4,832,631 * 5/1989 Gag ..... 440/101
5,482,434 * 1/1996 Heaven ..... 440/101

FOREIGN PATENT DOCUMENTS

299630 * 4/1992 (DE) ..... 440/101
4300324 * 7/1994 (DE) ..... 440/101

* cited by examiner

*Primary Examiner*—Stephen Avila
(74) *Attorney, Agent, or Firm*—Johnson & Steinbrook, LLP; Larry D. Johnson; Craig M. Stainbrook

(57) ABSTRACT

An improved propulsion apparatus for use in propelling shallow draft watercraft and adaptable for use as either an oar or a paddle, said apparatus comprising at least one split blade. The split blade has a front and at least one back blade section, each of which has surface topography on its working surface comprising channel dividers and fluted channels defined thereby for channeling water across the front surfaces of the front and back blade sections of the blade when in use. The paddle may be either single or double-bladed, suitable, e.g., for canoeing or kayaking, respectively. A second embodiment is adapted for use as an oar. In either embodiment, the front and back blade sections are preferably conjoined to form an oblique opening the two sections for advantageously channeling water.

21 Claims, 7 Drawing Sheets

SPLIT-BLADED PROPULSION APPARATUS

BACKGROUND OF THE INVENTION

1. Field of the Invention

The present invention relates generally to a propulsion apparatus for water sports, and more particularly to a rowing apparatus having a split blade and surface contours and adaptable for use as either an oar or a paddle.

2. Description of the Prior Art

The present invention represents a development from and an improvement on an earlier invention of the same inventor, entitled contoured paddle for water sports, and disclosed in U.S. Utility Patent Application filed Aug. 30, 1999. The prior design comprises, in part, a blade with surface topography for advantageously channeling water over the blade face when in use, and further has a crooked loom for increasing propulsive force. The surface topography comprises fluted channels formed in conjunction with a plurality of gently curving, raised channel ridges. The fluted channels direct water over the sweet spot (or center) of the blade, thereby increasing thrust, and thereafter conduct the water to the blade edges and outwardly in a fashion that evenly distributes water flow, thereby aiding blade stability and propulsion. The primary principle in operation is the Bernoulli effect, which describes local pressure differentials produced by varying velocities of fluid. These pressure differentials are exploited by the contoured paddle to increase efficiency while decreasing the strain on the user.

In certain applications and uses, it would be advantageous to further exploit the principles in effect in the contoured paddle. The present invention represents such an advance.

SUMMARY OF THE INVENTION

According to the present invention, there is provided an improved propulsion apparatus which may be embodied as either an oar or paddle, said oar or paddle being adapted to propel shallow draft watercraft, including kayaks, canoes, racing shells, rafts, skiffs, and the like. The oar or paddle comprises a handle portion, or loom, and at least one split blade, depending upon its use. The split blade comprises at least two working surfaces, preferably only two, having a front and a back blade section, each one of which has topography on its working surface. The topography comprises channel dividers and fluted channels defined thereby for channeling water across the front surfaces of the front and back blade sections of the blade when in use.

As a first preferred embodiment, the present invention may be either a single or double-bladed paddle, suitable, e.g., for canoeing or kayaking, respectively. A second embodiment of the present invention is adapted for use as an oar for rowing shells or white water rafts. In either embodiment, the front and back blade sections may be conjoined to form an opening between the two sections for further advantageous channeling of water.

DETAILED DESCRIPTION OF A PREFERRED EMBODIMENT

Figure 1:
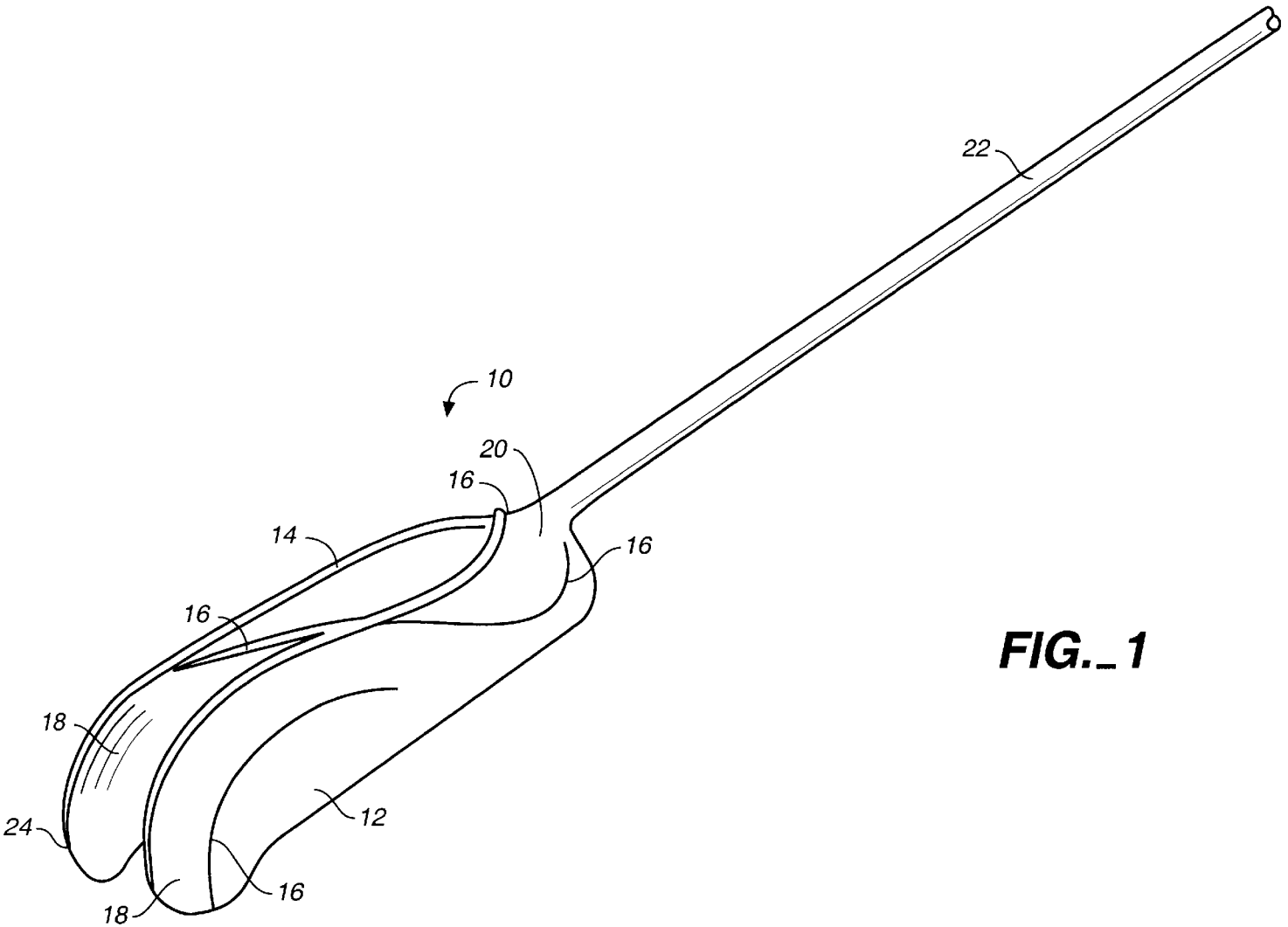
FIG. 1 is a perspective view of a first embodiment of the split blade paddle of the present invention showing the blade connected to a handle.
Figure 2:
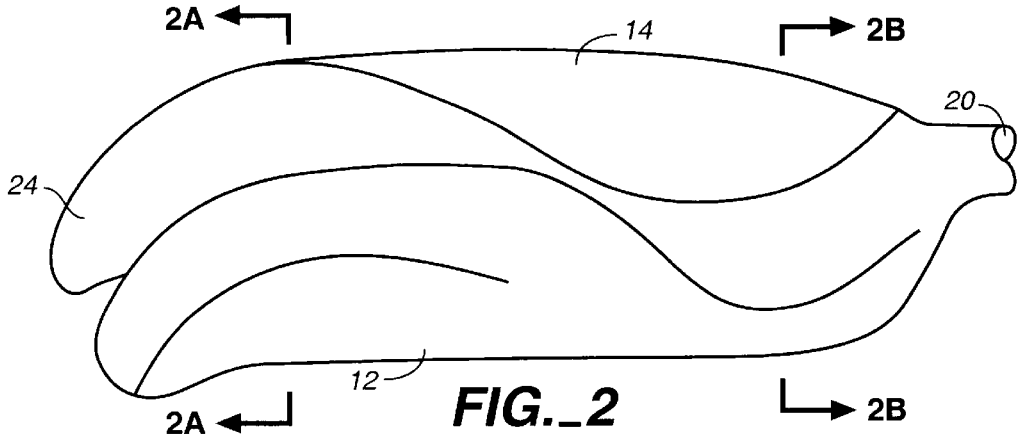
FIG. 2 is side elevation view of the left front face blade portion of the split blade paddle of FIG. 1, Showing the "composite" blade, which includes both the front and back blade sections as joined together.

FIG. 1 is a perspective view of a first embodiment of the split blade propulsion apparatus of the present invention, showing the blade connected to a handle, and FIG. 2 is side elevation view of the left front face blade portion of the split blade paddle of FIG. 1. This first embodiment is adapted for use as a paddle blade for propelling shallow draft watercraft such as canoes, kayaks, rafts, and the like. These views show that the split blade paddle, generally denominated 10, has at least two working surfaces (also known as power faces), preferably including a front blade section 12, and a back blade section 14, each having a contoured working surface, that is, a surface topography, comprised of channel dividers 16, and fluted channels 18, for channeling water across the front surface of each of said front and back blade sections of the split blade when in use. (As used herein, "working surface" or "power face" refers to that surface of the blade that moves against the water during a productive stroke.) While it is possible for the front and back blade sections to remain physically unconnected, preferably the front and back blade sections are conjoined in a "split-blade" configuration having a proximal end 20 for connection to a handle (or loom) 22, and a distal end 24. In the preferred embodiment, the front blade section is offset in a position slightly below and overlapping the back blade section.

Figure 2A:
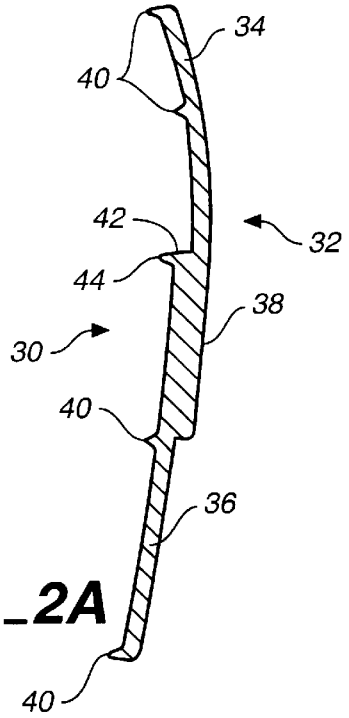
FIG. 2A is a cross-sectional end view on the cutting plane shown in FIG. 2.

FIG. 2A is a cross-sectional end view along the cutting plane shown in FIG. 2. This view shows that when viewed on end near the distal end the split blade paddle has a concave profile to its working surface 30, and a convex profile to its non-working surface 32. The back blade section 34 and front blade section are conjoined to form a region of overlap 38. This view further shows the topography of the working surfaces, including channel ridges 40, are shown to have a taper from base 42 to tip 44.

Figure 2B:
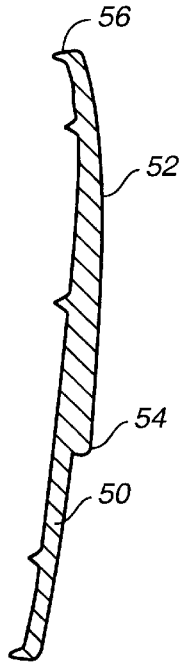
FIG. 2B is a cross-sectional end view on the cutting plane shown in FIG. 2.

FIG. 2B is a cross-sectional end view along the cutting plane shown in FIG. 2. This view shows that when viewed on end near the proximal end, the split blade paddle has a substantially larger area of overlap between the front blade section 50 and the back blade section 52, than at the distal end, such that the sections are effectively unified from the lowest point of overlap 54 to the upper edge 56 of the blade.

Figure 3A:
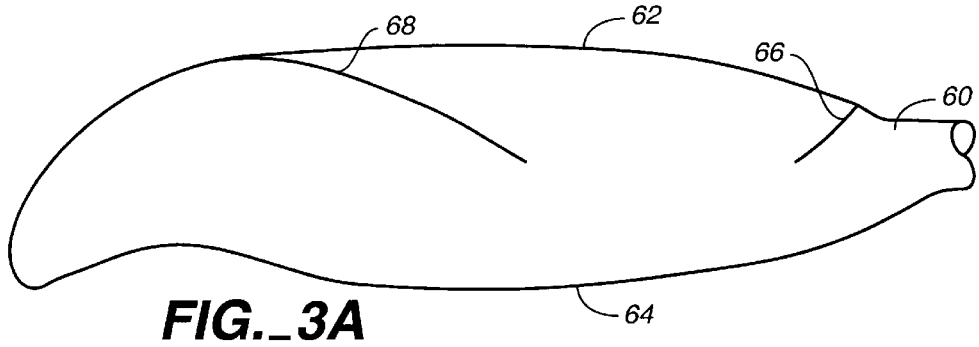
FIG. 3A is a side elevation view of the back blade section of the split blade paddle.
Figure 3B:
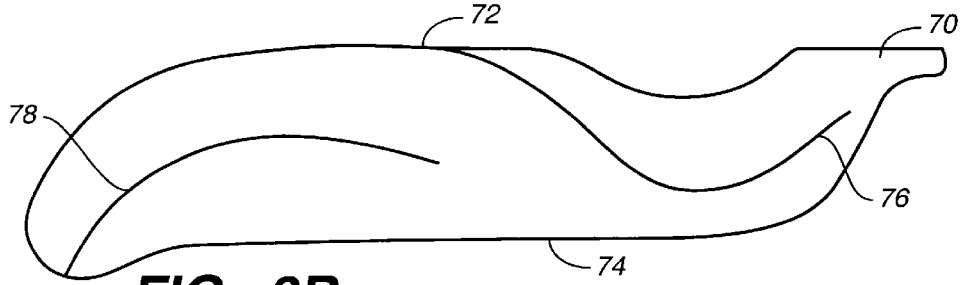
FIG. 3B is a side elevation view of the front blade section of the split blade paddle.
Figure 4:
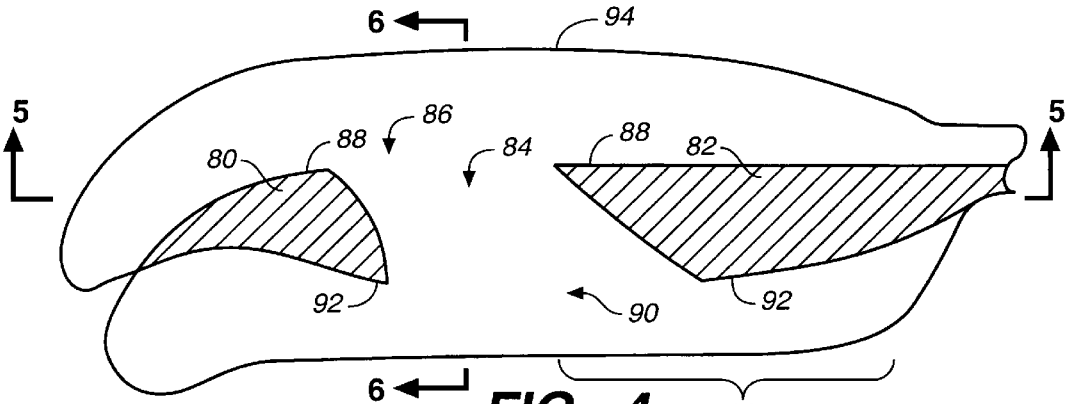
FIG. 4 is side elevation cross-sectional view of the split blade paddle showing the regions of physical connection between the front and back blade sections.

FIG. 3A is a side elevation view of the back blade section 60 of the split blade paddle, which section has an upper edge 62 and a lower edge 64. This view shows that the back blade section has a first channel divider 66 and a second channel divider 68, which are discontinuous with one another. FIG. 3B is a side elevation view of the front blade section 70 of the split blade paddle, showing that this blade section has an upper edge 72 and a lower edge 74, and first and second channel dividers 76 and 78, respectively FIG. 4 is side elevation cross-sectional view of the split blade paddle showing the two general regions of physical connection between the front and back blade sections, including a distal region 80 and a proximal region 82. The front and back blade sections need not be conjoined to provide certain hydrodynamic advantages when in use, but in the preferred embodiment the sections are conjoined so as to create an oblique opening 84, or through channel, between the back of the front blade section and the front of the back blade section. The through channel has a water inlet opening 86 proximate the front blade section upper edge 88 for the inlet of water flowing along the front surface of the back blade section and an expanded water outlet 90 proximate the lower edge 92 of the back blade section for the dissipation of water outwardly and downwardly from the working surface of the back blade section.

Preferably the back blade section includes an upper curled edge 94, which curls backwardly toward the working surface of the back blade section and effectively "grips" the water during a working stroke so as to increase the volume of water retained and channeled across the blade surface. Additionally, the front blade section preferably includes a proximal section of a beveled lower edge 96 having a ridge generally perpendicular to the plane of the working surface.

Figure 5:
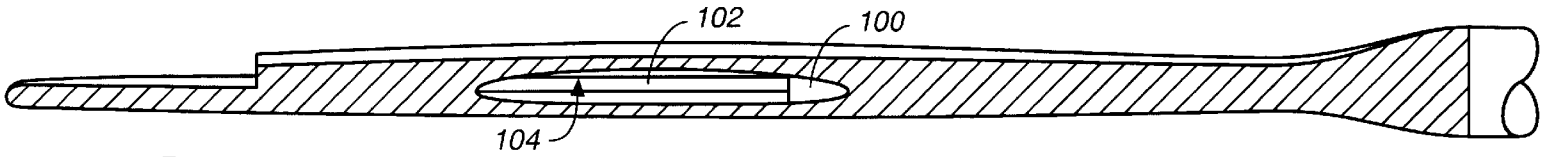
FIG. 5 is a bottom cross-sectional view of the split blade paddle as viewed from the cutting plane shown in FIG. 4.

FIG. 5 is a bottom cross-sectional view of the split blade paddle as viewed from the cutting plane shown in FIG. 4 showing the water inlet opening 100 of the through channel 102 of the split blade between the front working surface of the back blade section and the rear surface of the front blade section. This shows that through channel 102 has a generally oblong cross section. The edge of the upper curled edge 104 of the back blade section is visible through the through channel.

Figure 6:
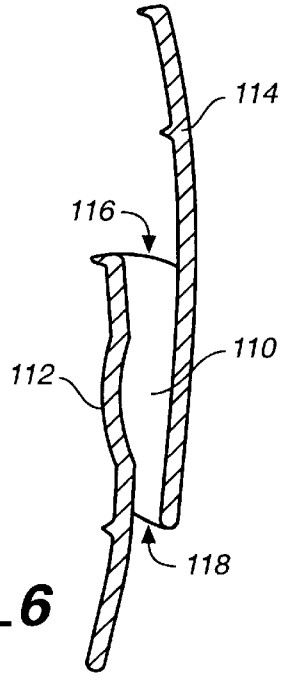
FIG. 6 is an end elevation cross-sectional view of the split blade paddle as viewed from the cutting plane shown in FIG. 4.

FIG. 6 is an end elevation cross-sectional view of the split blade paddle as viewed from the cutting plane shown in FIG. 4. This view provides another depiction of the through channel 110 formed by the combination of the front and back blade sections, 112 and 114, respectively, and more particularly how through channel 110 narrows from the inlet opening 116 at its upper end to the discharge opening 118 at its lower end.

Figure 7:
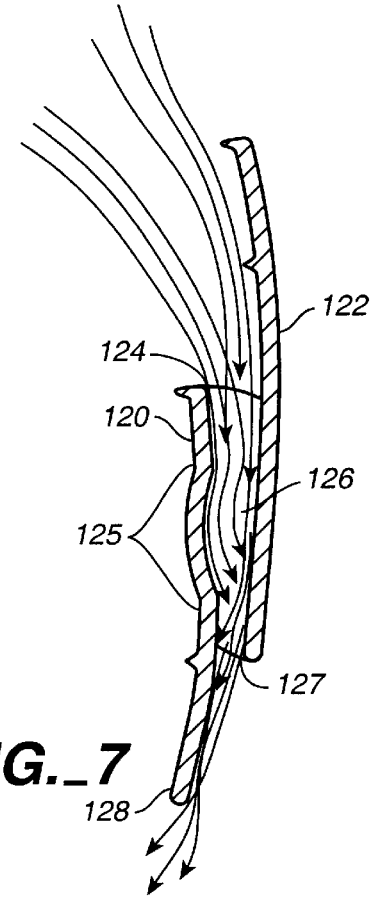
FIG. 7 is an end elevation cross-sectional view of the split blade paddle as viewed from the cutting plane shown in FIG. 4, showing the theoretical hydrodynamic water flow pattern between the front and back blade sections when in use.

FIG. 7 is an end elevation cross-sectional view of the split blade paddle as viewed from the cutting plane shown in FIG. 4, showing the theoretical hydrodynamic water flow pattern, W, between the front and back blade sections, 120 and 122, respectively, when in use. It will be appreciated that water entering water directed into inlet opening 124 is rapidly accelerated as it moves downwardly via through opening 126 toward the lower edge 128 of the front blade section. Preferably opening 126 includes a bulge region 125 where the opening profile widens from the inlet opening profile. At this stage in the opening the moving water decelerates and momentarily pools before being rapidly accelerated through outlet opening 127, which is narrower than both inlet opening 124 and bulge region 125. The actual size of the bulge region can be tailored to the desired characteristics of the blade, with a larger region providing more propulsive force.

Figure 8:
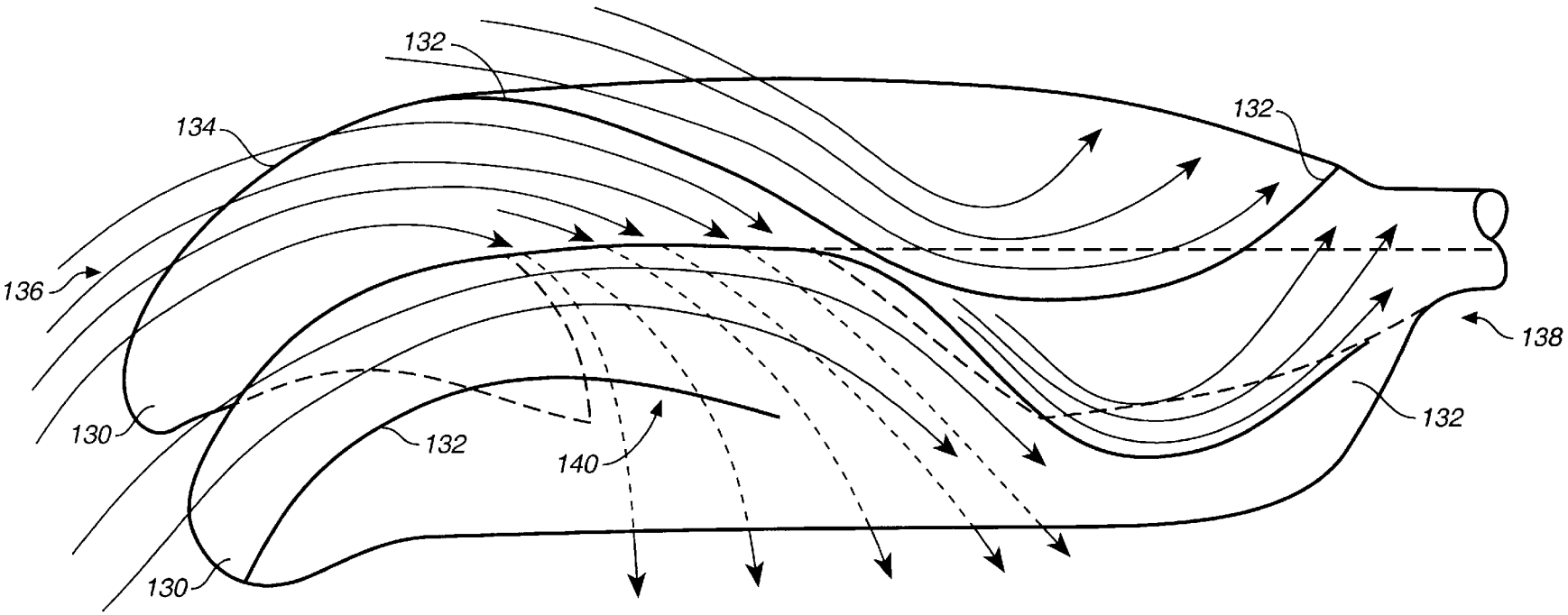
FIG. 8 is a side elevation view of the theoretical hydrodynamic water flow across the working surface of the split blade paddle.

FIG. 8 is a side elevation view of the theoretical hydrodynamic water flow across the entire working surface of the split blade paddle. This view shows that the front and back blade sections combine to conduct water across the working surfaces of the composite paddle. More specifically, the surface topography of the blade sections, including fluted channels 130, channel dividers 132, and upper curled edge 134, conduct water longitudinally and transversely, and in combinations thereof, across the working surfaces of the blade's two sections, moving from the distal end 136 toward the proximal end 138. Broken lines depict water flow via the through channel 140, which generally defines the center of mass of the blade sections, individually and collectively. A paramount feature of the contoured blade surfaces is that the water moves generally across the center of mass and propulsive force, proximate to but not necessarily located at the geometrical center of the blade. This is the "sweet spot" of the blade, and by concentrating water at this locus, propulsive force is increased while torsional forces that cause blade flutter are reduced. After directing water across the sweet spot of the working surface of the paddle or oar, the channels then broadcast the water outwardly from the center and to and from the edges of the blade in a balanced fashion. While increasing the propulsive effect of the stroke, this pattern of water movement further decreases torsional forces at the edges of the blade. The blade therefore feels more stable to the user.

Each section of the split blade may be either substantially flat or gently curved when viewed from above in their profile aspect. Additionally, the sections, individually or in combination, may be symmetrical or asymmetrical, though the preferred design for a split blade paddle is asymmetrical, as illustrated by the drawings herein.

Figure 9:
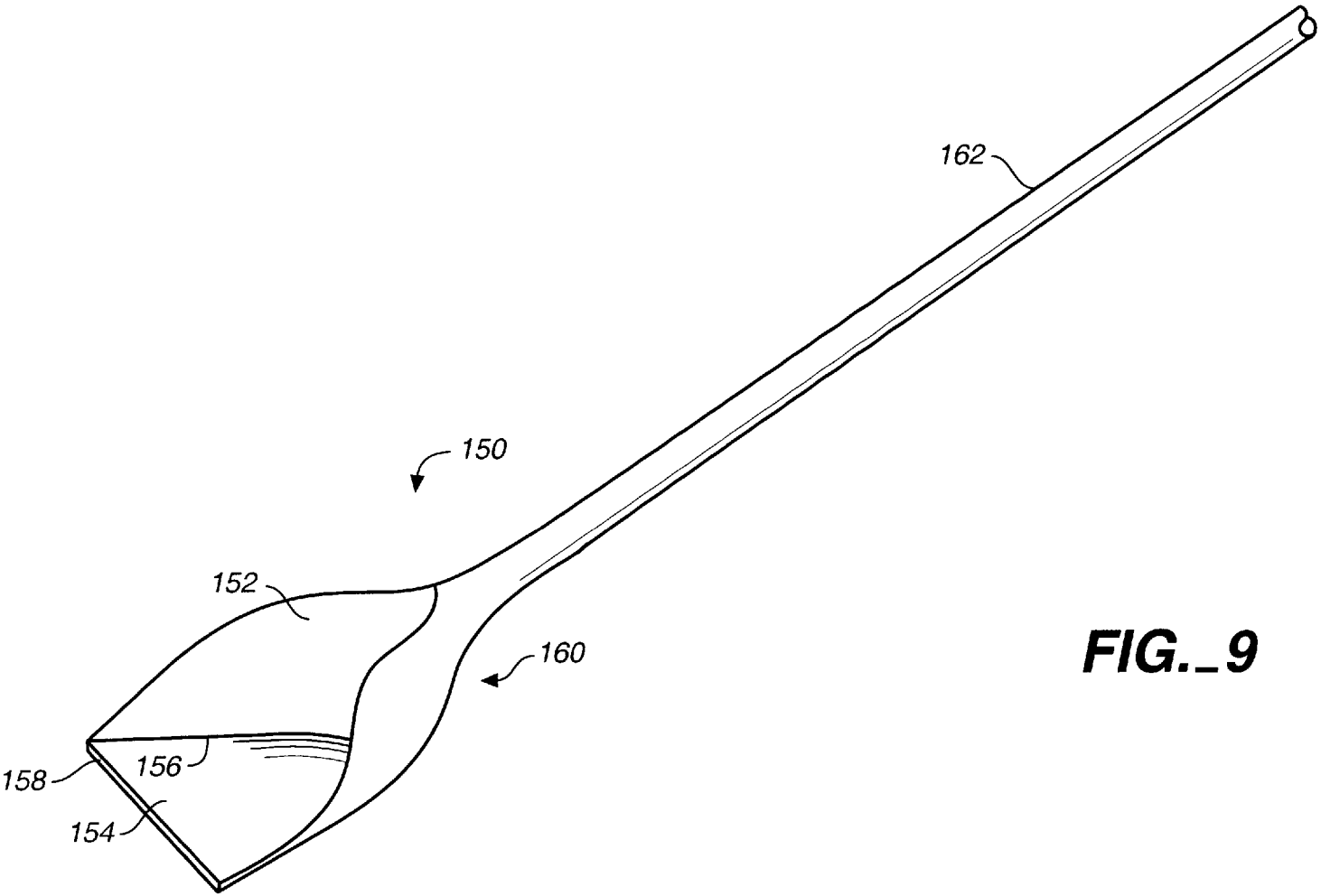
FIG. 9 is a perspective view of a second embodiment of the present invention, showing a split blade oar with a handle.
Figure 10:
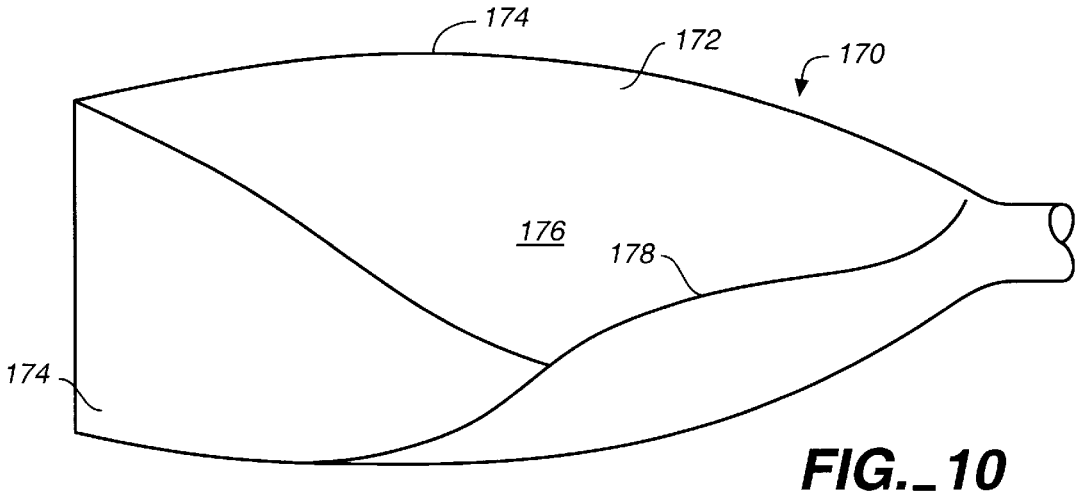
FIG. 10 is a side elevation view of the combined front and back blade sections of the "composite" split blade oar.
Figure 11A:
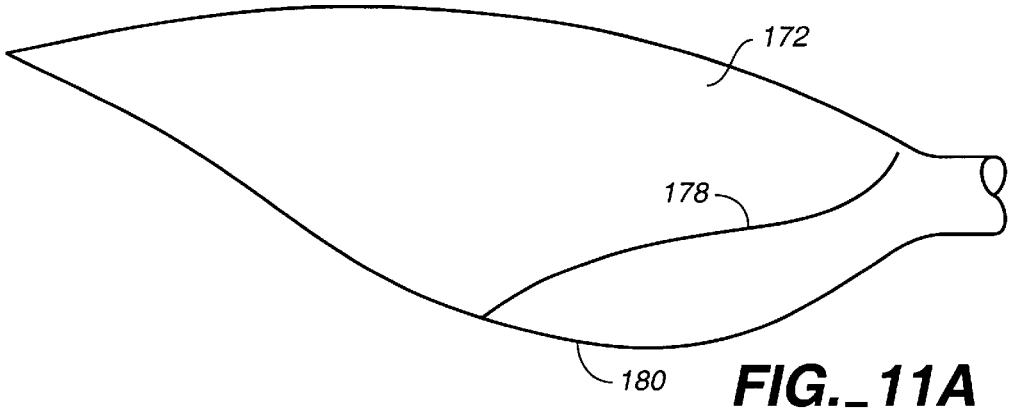
FIG. 11A is a side elevation view of the front blade section of the split blade oar.
Figure 11B:
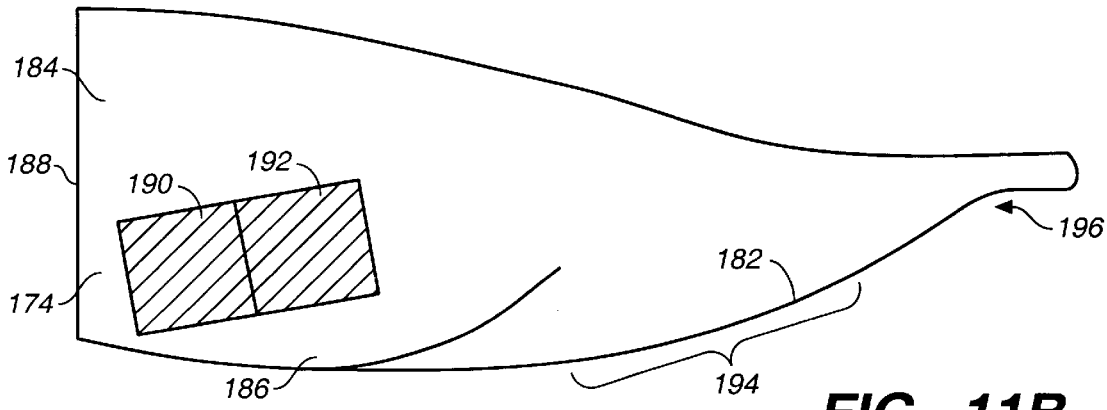
FIG. 11B is a side elevation view of the back blade section of the split blade oar.

FIG. 9 is a perspective view of a second embodiment of the present invention, showing a split blade oar 150. FIG. 10 is a side elevation view of the combined front and back blade sections of the "composite" split blade oar. FIG. 11A is a side elevation view of the front blade section of the split blade oar. FIG. 11B is a side elevation view of the back blade section of the split blade oar. These figures show that the split blade oar has elements and topographical features corresponding to those of the split blade paddle, but tailored to the fluid dynamics connected with rowing rather than paddling. Specifically, as shown in FIG. 9, the split blade oar comprises a front blade section 152 and a back blade section 154, said front and back blade sections preferably conjoined to form an oblique through channel 156. The oar has a generally straight distal end 158 and a proximal end 160 for connection to an oar handle 162.

As shown in FIGS. 10 through 11B, the composite oar blade 170 comprises conjoined back blade section 172 and front blade section 174. Front blade section 172 has a graduated curled upper edge 174 for gripping water during a productive stroke. The working surface of the front blade section has a sloping face 176 that slopes upwardly from the curled edge 174 to a channel ridge 178 sweeping generally longitudinally along the lower portion of the front blade section, and thereafter slopes downwardly from the channel ridge 178 to the lower border 180 of the front blade section, which in the preferred embodiment is contiguous with and joins the lower portion of the back blade section 182.

The back blade section 174 of the split blade oar has an upper grooved channel 184 and a lower grooved channel 186, each of which direct and rapidly accelerate water along the working surface and into the through channel. Additionally, the distal portion 188 of the split blade oar, comprising the distal portion of the back blade section, preferably includes a shallow fluted channel 190 near the distal edge 188, which edge is preferably straight, and a deep fluted channel 192 more proximate the center of the blade. Preferably, back blade section 174 has a beveled section 194 of lower edge 182, said beveled section commencing where the lower edge begins to taper and converge toward the upper edge to form the proximal end 196 where the oar is adapted for connection to a handle.

Figure 12:
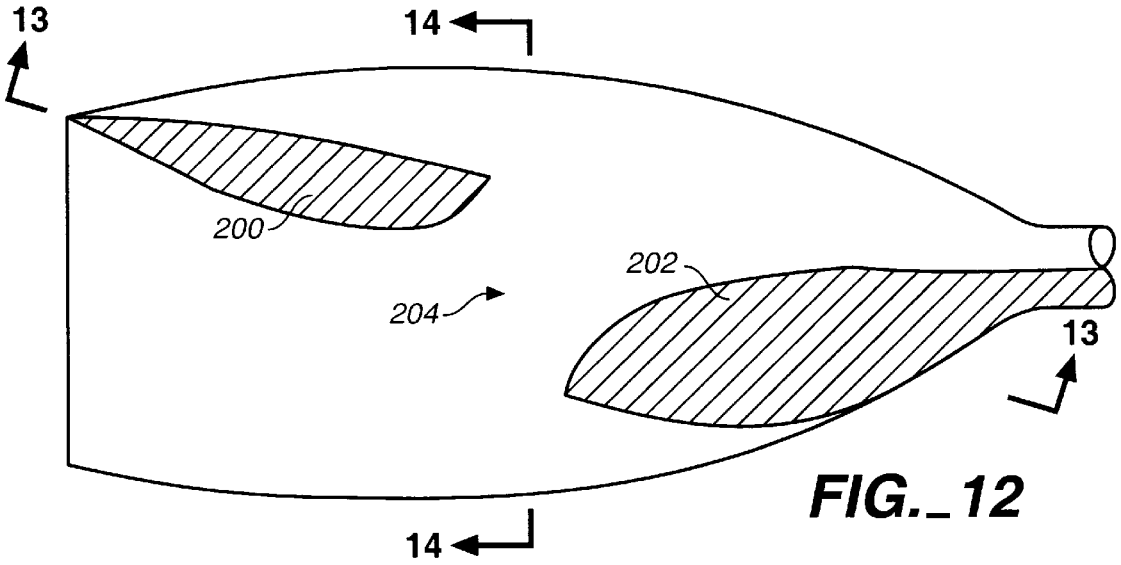
FIG. 12 is a side elevation cross-sectional view of the composite oar of FIG. 10, showing the regions of connection between the front and back blade sections.

FIG. 12 is a side elevation cross-sectional view of the composite oar of FIG. 10, showing the distal and proximal regions of connection, 200 and 202, respectively, between the front and back blade sections, and through channel 204 defined by a region between the regions of connection and the front and back oar blade sections.

Figure 13:
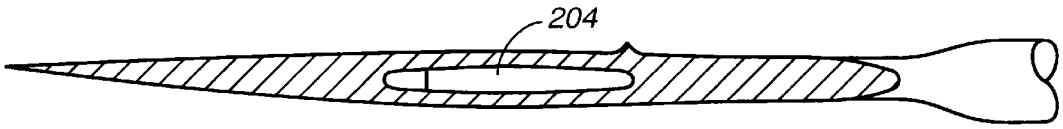
FIG. 13 is a bottom cross-sectional view of the split blade oar as viewed from the cutting plane shown FIG. 12.
Figure 14:
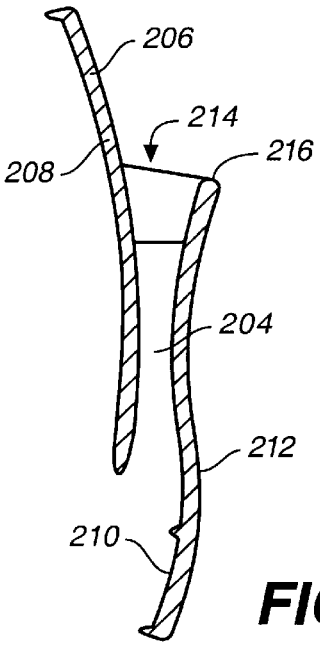
FIG. 14 is an end elevation cross-sectional view of the oar as viewed from the cutting plane shown in FIG. 12.

FIG. 13 is a bottom cross-sectional view of the split blade oar as viewed from the cutting plane shown in FIG. 12, and FIG. 14 is an end elevation cross-sectional view of the oar as viewed from the cutting plane shown in FIG. 12.

Referring now to FIG. 14, as with the split blade paddle, the water inlet to the through channel 204 of the split blade oar has a relatively broad opening. However, the sides of the through channel, defined by the back side 206 of front blade section 208 and the front side 210 of back blade section 212 quickly converge to choke the water into a narrow passage. This narrowing functions as a venturi to jet flowing water toward and through outlet 214, located at the upper border 216 of the back blade section. From this drawing it will be apparent that the inventive apparatus as embodied in an oar contemplates having the front blade section positioned above the back blade section. This contrasts with the above-described paddle, wherein the orientation is reversed.

It may be appreciated that the general shape of the conjoined sections in this second embodiment may also be either flat or curved, symmetrical or asymmetrical. Preferably, the combined front and back blade sections form a generally symmetrical oar when viewed directly in front of the working surfaces. Curvature may be unidirectional or about a center located at the approximate geometric center of the blade sections. As is well known in the art, curvature may be introduced to accentuate the water trapping or "gripping" feature of the blade. This principle applies equally well to the present invention, though the surface topography relegates blade shaping to an optional characteristic for customization only.

Paddles and oars are employed for a variety of purposes. Accordingly, the size, shape, and precise surface topography of the composite split blade paddles and oars may be varied. Competitive racers, for example, may require a size, shape, and working surfaces designed to maximize thrust under a manageable and sustainable muscular exertion. Touring and other recreational users may prefer a configuration designed to provide optimum velocity under considerably more modest propulsive forces while also minimizing the strain and fatigue suffered by the user. This need for application-specific customization highlights one of the significant advantages of the present invention: namely, increased versatility.

It will further be appreciated that the present invention is adapted for connection to either paddle or oar handles, and in the former instance either to double-bladed paddles (e.g., kayak paddles) or single-bladed paddles (e.g., canoe paddles). Furthermore, when configured in a double-bladed paddle, the paddle may be either feathered or non-feathered.

When interpreting the drawings herein, it must be understood that when paddling, the power face is pulled toward the user; when rowing, the power face is "pulled" away from the rower via the radial motion of the oar due to its fixed axis in the oar lock.

While this invention has been described in connection with preferred embodiments thereof, it is obvious that modifications and changes therein may be made by those skilled in the art to which it pertains without departing from the spirit and scope of the invention. Accordingly, the scope of this invention is to be limited only by the appended claims.

What is claimed as invention is:

1. A propulsion apparatus for use in propelling shallow draft watercraft, comprising:

a front blade section having a working and a non-working surface and an upper and lower edge;

at least one back blade section in addition to said front blade section, positioned behind said front blade section, and having a working and a non-working surface, and further having an upper and lower edge, wherein said front blade section is offset and slightly lower than said back blade section;

a distal end;

a proximal end for connection of at least one of said blade sections to a handle; and a handle connected to said proximal end.

2. The propulsion apparatus of claim 1, wherein said front and back blade sections are conjoined.

3. The propulsion apparatus of claim 1, wherein said front blade section has surface topography on said working surface comprising at least one channel divider defining at least one fluted channel; and wherein said back blade section has surface topography on its working surface, said topography comprising at least one channel divider defining at least one fluted channel.

4. The propulsion apparatus of claim 3, wherein said surface topography of said back blade section includes at least one curled upper edge portion comprising a segment of said upper edge of said back blade section and curling inwardly toward said front paddling surface.

5. The propulsion apparatus of claim 3 wherein said front blade section has rear surface channel dividers on its non-working surface and wherein said front and back blade sections are conjoined so as to form an oblique through channel between said rear non-working surface of said front blade section and said working surface of said back blade section, said through channel defined by said channel dividers on said back blade section and said rear surface channel dividers, and said through channel having an water inlet and a water outlet.

6. The propulsion apparatus of claim 5 further comprising a grooved channel, said grooved channel defined by said channel dividers on said front and back blade sections, said grooved channel channeling water along between the working surface of said back blade section and the non-working surface of said front blade section and directly into said through channel.

7. The propulsion apparatus of claim 1 wherein said front blade section and said at least one back blade section are curved from the proximal to distal ends when viewed on edge.

8. The propulsion apparatus of claim 1 wherein said front blade section and said at least one back blade section are correspondingly curved in every direction about a center of curvature located at substantially the geometric center of each of said front and back blade sections.

9. The propulsion apparatus of claim 1 wherein said front blade section and said at least one back blade section are flat from their proximal to distal ends when viewed on edge.

10. The propulsion apparatus of claim 1 wherein said apparatus is a paddle adapted for use in propelling shallow draft watercraft such as canoes, kayaks, skiffs, and rafts.

11. The propulsion apparatus of claim 10 wherein said front and back blade sections are substantially asymmetrical.

12. The propulsion apparatus of claim 1 wherein said apparatus is an oar adapted for use in propelling shallow draft watercraft such as rowing shells, skiffs, and rafts.

13. The propulsion apparatus of claim 12 wherein said distal end of said oar defines a substantially straight line.

14. A paddle adapted for use in propelling shallow draft watercraft such as canoes, kayaks, and rafts, comprising:

a front blade section having a working and a non-working surface and an upper and lower edge;

at least one back blade section positioned behind said front blade section, and having a working and a non-working surface, and having an upper and lower edge, said back blade section offset and positioned slightly above said front blade section and conjoined to said front blade section;

a distal end;

a proximal end for connection to a handle; and a handle connected to said proximal end.

15. The paddle of claim 14 wherein said front blade section has surface topography on said working surface comprising at least one channel divider defining at least one fluted channel; and wherein said back blade section has surface topography on its working surface, said topography comprising at least one channel divider defining at least one fluted channel.

16. The paddle of claim 15, wherein said surface topography of said back blade section includes at least one curled upper edge portion comprising a segment of said upper edge of said back blade section and curling inwardly toward said front paddling surface; and wherein said front blade section has rear surface channel dividers on its non-working surface and wherein said front and back blade sections are conjoined so as to form an oblique through channel between said rear non-working surface of said front blade section and said working surface of said back blade section, said through channel defined by said channel dividers on said back blade section and said rear surface channel dividers, and said through channel having an water inlet and a water outlet; and wherein said paddle blade further comprises a grooved channel, said grooved channel defined by said channel dividers on said front and back blade sections, said grooved channel channeling water between the working surface of said back blade section and the non-working surface of said front blade section and directly into said through channel.

17. An improved rowing apparatus, comprising:

a lower blade section having a working and a non-working surface;

an upper blade section having a working and a non-working surface and operatively connected to said lower blade section, said upper blade section positioned such that its working surface faces the non-working surface of said lower blade section;

a distal end;

a proximal end for connection of at least one of said blade sections to a handle; and a handle connected to said proximal end;

wherein said upper and lower blade sections form an oblique through channel between said upper and lower blade sections, said through channel having an water inlet and a water outlet.

18. An oar blade adapted for use in propelling shallow draft watercraft such as rowing shells, and skiffs, comprising:

a front blade section having a working and a non-working surface and an upper and lower edge, wherein said upper edge of said front blade section has a graduated curled edge, said front blade section further having a sloping face that slopes upwardly from said curled edge to a channel ridge sweeping generally longitudinally along the lower portion of the front blade section, and thereafter sloping downwardly from said channel ridge to said lower border, said lower border being contiguous with the lower portion of said back blade section;

at least one back blade section positioned behind said front blade section, and having a working and a non-working surface, and having an upper and lower edge, said back blade section conjoined to said front blade section;

a distal end;

a proximal end adapted to be connected to a handle; and a handle connected to said proximal end.

19. The oar blade of claim 18 wherein said front and back blade sections are conjoined to form an oblique through channel, said through channel defined by rear channel ridges on said front blade section and the conjoined working surface of said back blade section and non-working surface of said front blade section, said through channel having an elongate water inlet for the introduction of flowing water into the through channel, and a water outlet for the dissipation of water from the through channel.

20. The oar blade of claim 18 wherein said back blade section has an upper grooved channel and a lower grooved channel, positioned to direct and accelerate water along said working surface into said through channel during a productive stroke, and having a distal portion which includes a shallow fluted channel near said distal end, said distal end being substantially straight, and further having a deep fluted channel more proximate to the through channel.

21. The oar blade of claim 18 wherein said lower edge of said back blade section has a beveled section.

* * * * *